United States Patent [19]

Yoon

[11] Patent Number: 4,765,066

[45] Date of Patent: Aug. 23, 1988

[54] MICROWAVE CLOTHES DRYER

[75] Inventor: Chang-Hyun Yoon, Palisades Park, N.J.

[73] Assignee: VBE Inc., Birmingham, Mich.

[21] Appl. No.: 86,974

[22] Filed: Aug. 19, 1987

[51] Int. Cl.[4] ..... F26B 23/08

[52] U.S. Cl. ..... 34/1; 34/68; 219/10.55 R

[58] Field of Search ..... 34/1, 68, 4; 219/10.55 R, 10.55 D, 10.55 E

[56] References Cited

U.S. PATENT DOCUMENTS

| | | | |
|---|---|---|---|
| 4,334,136 | 6/1982 | Mahan | 34/1 |
| 4,356,640 | 11/1982 | Jansson | 34/1 |
| 4,510,361 | 4/1985 | Mahan | 34/1 |
| 4,523,387 | 6/1985 | Mahan | 34/1 |

*Primary Examiner*—Larry I. Schwartz

*Attorney, Agent, or Firm*—Lerner, David, Littenberg, Krumholz & Mentlik

[57] ABSTRACT

A microwave clothes dryer is disclosed. The dryer includes a rotatable drum that is supported at one of its ends by an annular driven pulley member which is rotatingly carried by and bears upon a cantilevered cylindrical bearing support member. A motor, drive pulley and drive belt rotate the annular driven pulley member and the drum to which it is attached. A magnetron provides microwave energy to the interior of the dryer and a blower circulates forced air through the dryer, cooling the magnetron and removing water vapor from the interior of the drum. The inner periphery of the annular pulley member includes a circumferential slot that communicates with a microwave energy leakage path that has a length approximately equal to one-quarter of the wave length of the microwave energy and which extends from the interior of the drum to and through the clearance space between the annular pulley member and the cylindrical bearing support member. The interior of the annular pulley member is so dimensioned as to form a microwave choke or trap that is in communication with the leakage path for attenuating the leakage of microwave energy via such path. Additional microwave gaskets may be employed in the leakage path, and an access door having microwave leakage sealing features therein is positioned adjacent to the drum at its end opposite to its end which is supported by the annular pulley member.

10 Claims, 3 Drawing Sheets

FIG. 3
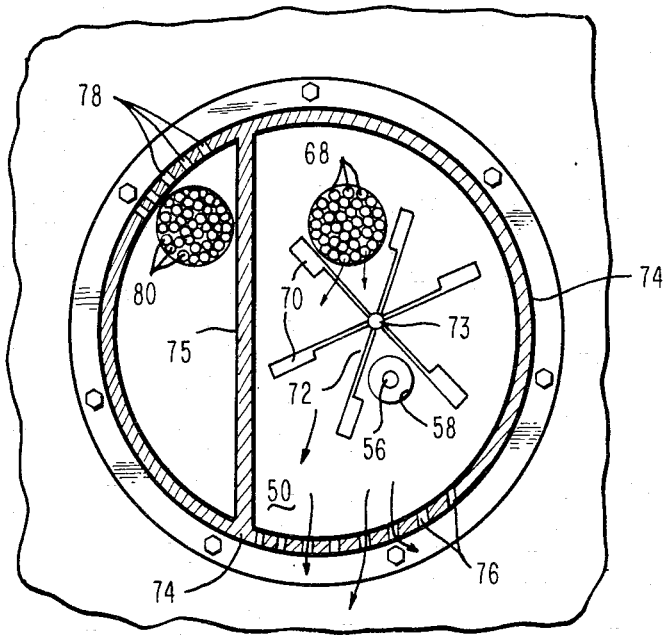
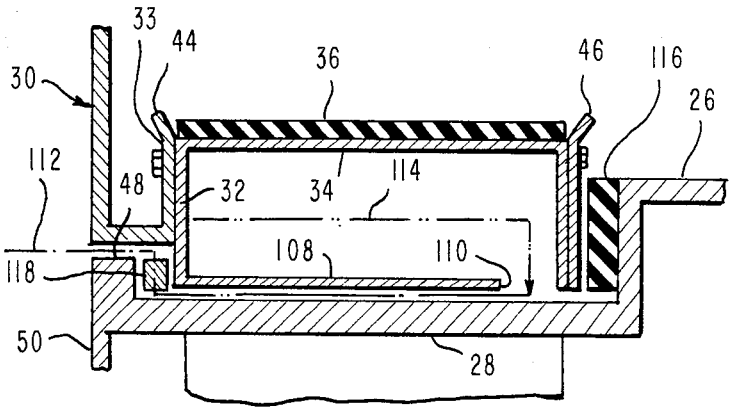
FIG. 4

MICROWAVE CLOTHES DRYER

FIELD OF THE INVENTION

The present invention relates to microwave clothes dryers and, more particularly, to microwave leakage sealing arrangements for the drum drives of such dryers.

BACKGROUND OF THE INVENTION

Microwave clothes dryers have heretofore been patented, as is apparent from those illustrated for example in U.S. Pat. No. 4,334,136 to Mahan et al, U.S. Pat. No. 4,356,640 to Jansson, U.S. Pat. No. 4,510,361 to Mahan, and U.S. Pat. No. 4,523,387 to Mahan. Such dryers generally comprise horizontal axis tumbler-type rotary drums in housings arranged to receive articles from which moisture is to be removed. The drums are rotatably supported, usually by cantilevered bearing supports, and the dryer housings include front doors through which articles are loaded into and unloaded from the drum. Microwave power means, such as magnetrons, are mounted in the housings, or in the doors, and have their outputs directed into the drum. Forced air is employed for removing moisture from the drums and, in many cases, to also cool the microwave power means. The microwave power means, in turn, heats the forced air before the latter's entry into the drum, to increase the vapor carrying capability of the forced air.

Although provisions have been made in prior art microwave clothes dryers for limiting microwave leakage from the housing through the doors or other openings or seams of the dryer, which provisions generally are similar to those that have been developed in connection with sealing the doors of microwave ovens with respect to their stationary housings, little thought has been given to the manner in which microwave leakage can be sealed at the interface between rotary and stationary parts of the dryers, such as between the cantilevered stationary bearing support for the drums and the rotating drums themselves.

This problem has heretofore been considered in connection with sealing the rotary interface of a fan on a microwave oven with the stationary housing of the oven, as shown in U.S. Pat. No. 4,303,817 to Klement et al. However, the Klement et al approach does not take into account the significant differences extant between driving arrangements employed in driving a blower fan and driving arrangements employed in driving a heavily loaded dryer drum.

The problem has also been considered, at least in part, in the aforementioned U.S. Pat. No. 4,523,387 to Mahan, wherein a zig-zag labrynthine leakage path is provided between a rotary drum and its stationary housing in an attempt to limit microwave energy leakage therebetween. However, this arrangement is devoid of any microwave chokes or traps and, thus, can only provide limited attenuation of such leakage energy at best. Moreover, in this case the drum is supported at multiple points about its periphery, rather than by a cantilevered bearing support, so that there is no cooperative relationship extant between the sealing arrangement and the drum support and driving arrangement.

It is, therefore, a primary object of the present invention to provide an improved microwave clothes dryer having an improved microwave leakage sealing arrangement between the rotating drum thereof and a bearing support for the drum.

Another object of the present invention is to provide an improved microwave leakage sealing arrangement for a mirowave clothes dryer in which the microwave leakage seal also serves as a drive pulley for rotating the drum of the dryer.

A further object of the invention is to provide an improved microwave clothes dryer in which the drive mechanism for the dryer drum includes a microwave choke that surrounds the stationary bearing support for the drum and cooperates therewith to attenuate the leakage ofmicrowave energy from the drum.

Additional objects and advantages of this invention will become apparent as the following description proceeds.

SUMMARY OF THE INVENTION

Briefly staed, and in accordance with one embodiment of this invention, an improved microwave clothes dryer comprises a housing, a rotatable drum positioned within the housing and supported at one of its ends by a cylindrical bearing support which has an annular microwave choke member closely spaced from and surrounding its outer periphery. The annular choke member includes an opening therein on its inner surface, in communication with a microwave leakage path extending from the interior of the drum to the exterior surface of the bearing support, and it is fastened to the end surface of the drum in driving relationship therewith. The outer surface of the annular member is cylindrical in shape so as to serve as a driven pulley for the drum. The dryer includes a motor, a drive puley and a belt which extends from the drive pulley to the outer surface of the choke thereby to rotate the drum as necessary to dry the clothes in the drum. A magnetron is provided within the bearing support, adjacent to the end surface of the drum, and suitable blower means are provided which force air over the magnetron and into the drum in connection with the clothes drying process. The dryer is provided with a door for gaining access to the clothes dryer, which door includes a door sealing microwave choke therein.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which :

FIG. 3 is an enlarged sectional elevation view, taken along line 3—3 of FIG. 2;

FIG. 4 is an enlarged fragmentary sectional view showing details of the microwave leakage seal at the interface between the rotating drum and its cantilevered bearing support.

Figure 1:
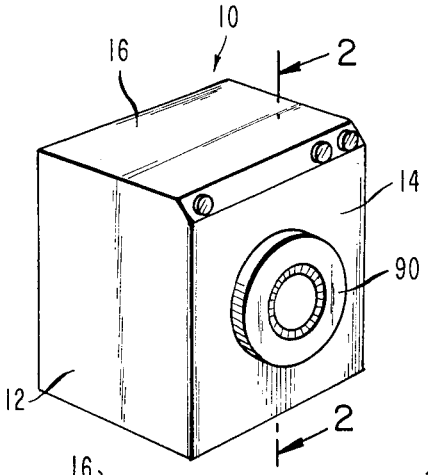
FIG. 1 is a perspective view of a microwave clothes dryer in accordance with the present invention.

Referring to the figures, a microwave dryer in accordace with this invention has been shown generally at 10. The dryer 10 includes an outer housing, comprising side, front, top and rear thin metal panels 12, 14, 16 and 18, respectively, which are fastened to one another and are carried by a thick metal base plate 20 to which they are also fastened. The dryer 10 includes a thick metal vertical support plate 22 which is welded or otherwise fastened to the base plate 20 at the rear portion of the dryer and extends upwardly therefrom to support the stationary and rotary internal parts of the dryer.

The upper end of vertical support plate 22 is provided with an aperture 24 within which one enlarged end portion 26 of a generally cylindrical bearing support member or means 28 is fixedly carried, for example by welding, bolting or the like. The bearing support member 28 is mounted as a cantilever from the vertical support plate 22 and, in turn, supports a tumbler cylinder or drum, shown generally at 30, by means of an annular pulley member 32, which is fastened to one end of the drum 30 via a flange member 33. Annular pulley member 32 closely surrounds and bears against the bearing support member 28 and, thus, functions as a sleeve bearing for supporting the tumbler cylinder 30 in cantilever fashion from the bearing support member 28. An outer portion 34 of annular pulley member 32 drivingly receives a drive belt 36 which is driven by a pulley 38 carried on the shaft 40 of a motor 42. The outer portion 34 of annular pulley member 32 includes a pair of annular flange member 44, 46 which serve to keep the belt 36 entrained on the outer surface 34 of the annular pulley member 32.

The bearing support member 28 is provided with a second enlarged end portion 48, remote from the enlarged end portion 26 thereof, so as, in effect, to provide collars at each end of the bearing support member 28 within which the annular pulley member 32 rotates. The enlarged end portion 48 may, alternatively, be a collar that is fastened to the bearing support member 28 to facilitate assembly of the annular pulley member 32 onto the bearing support member 28.

Figure 2:
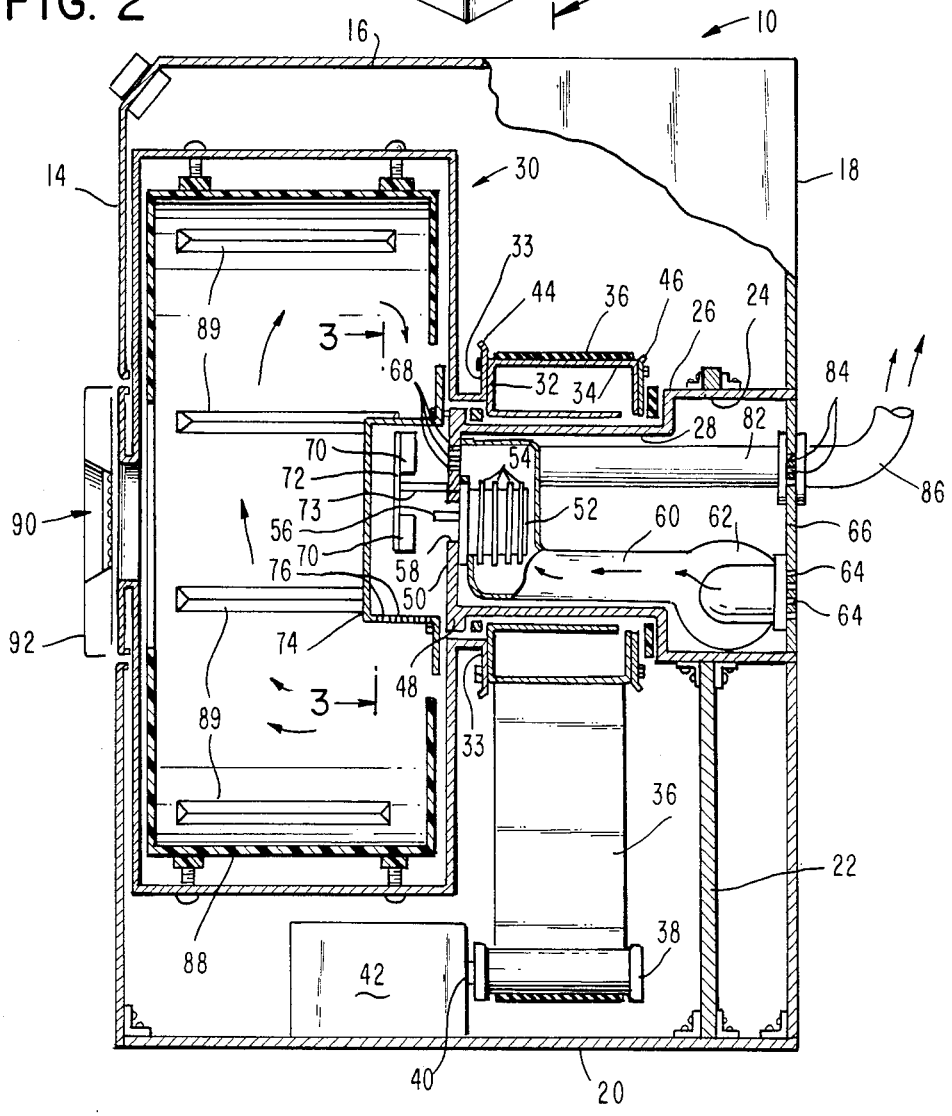
FIG. 2 is an enlarged sectional elevation view, taken along the line 2—2 of FIG. 1.

As shown most clearly in FIGS. 2 and 3, the bearing support member 28 is provided with an end plate 50, on one side of which is mounted a magnetron 52 having cooling fins 54 and an antenna 56 which projects through an aperture 58 in the end plate 50 to the opposite side of the end plate, into the interior of the drum 30.

The body portion of magnetron 52 and its cooling fins 54 are positioned in an air duct 60 through which ambient air under pressure flows from a blower 62, past the cooling fins 54 of the magnetron and into the interior of drum 30, via a path that includes intake apertures 64 formed in an end plate 66 carried at the end of the cylindrical bearing support member 28 opposite to the end plate 50. The end plate 66 may be welded, bolted or otherwise fastened to the enlarged end portion 26 of bearing support member 28. Air duct 60 directs the forced air, which has cooled the magnetron 52 and has itself become pre-heated, through a plurality of apertures 68 formed in end plate 50 and against the blades 70 of a windmill-like stirrer 72 that is rotatably mounted on a shaft 73 carried by end plate 50.

The stirrer 72 is positioned to rotate within one chamber (the right-side one, as viewed in FIG. 3) of two chambers of passageways formed in a microwave transparent shield 74 by a partition or wall member 75. The stirrer 72, which is preferably of aluminum or other microwave reflecting material, is arranged to rotate adjacent to antenna 56 of the magnetron in order to distribute microwave radiation from the antenna throughout the interior of the rotating drum 30 to facilitate the heating and drying of clothes carried therein. After impinging upon blades 70 of stirrer 72 and causing the stirrer to rotate, the air flow continues through the right-side chamber of the microwave transparent plastic shield 74 to the lower area of the shield. The air flow then proceeds into the interior of drum 30 via a plurality of apertures 76 formed in the lower portion of the right-side passageway of shield 74. The shield 74 is preferably bolted or otherwise fastened to the end plate 50 of bearing support member 28 and serves to shield the microwave antenna 56 and stirrer 72 from clothes that are tumbling within drum 30.

After passing through and assisting in the drying of clothing that is tumbling within drum 30, the moisture-laden, heated air flows out of drum 30 and into the left-side (as viewed in FIG. 3) chamber of shield 74 through a plurality of apertures 78. The moisture-laden, heated air then flows through another plurality of apertures 80 in end plate 50 and into a duct 82 (FIG. 2) which passes through the interior to the inboard surface of end plate 66, in communication with another plurality of apertures 84 which allow the exit air to flow through end plate 66. A suitable exhaust duct 86 is fastened to the outboard side of end plate 66 to lead the moisture-laden, heated air to the outside atmosphere. A suitable removable screen or metal mesh member (not shown) may be placed in exhaust duct 86, adjacent to endplate 66, to screen out lint particles and the like, in accordance with conventional practice.

The interior of drum 30 has fixed thereto a plastic liner member 88 having a plurality of inwardly directed ribs 89 thereon. The plastic liner 88 serves to prevent arcing from occuring between metal objects (e.g., buttons, zippers, etc.) on the clothing and the metal interior of the drum 30. The ribs 89 assist in causing clothing within the drum to rotate with the drum. Drum rotation is preferably in the range of 10 to 15 revolutions per minute in order to facilitate proper tumbling of the clothes in the drum.

Figure 5:
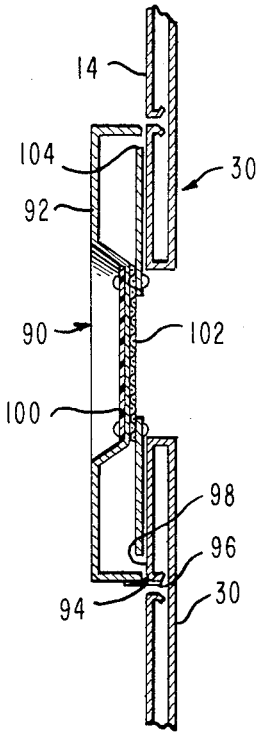
FIG. 5 is an enlarged fragmentary sectional view showing details of the microwave leakage seal at the interface between the rotating drum and a rotating access door.

The relationship between the blades 70 of the stirrer 72 and the air flow through the drum should be such that the stirrer rotates in a speed range that is sufficiently high to provide for even distribution of microwave energy within the tumbler drum during operation of the dryer, for example 30 to 150 rpm, in order to properly distribute microwave radiation through the clothing during the heating cycle. However, it should be noted that it is possible to design the tumbler drum sufficiently well as a microwave cavity that arcing within the tumbler drum is avoided. In this case the stirrer 72 and its blades 70 and shaft 73 can be eliminated. It should also be noted that the individual openings in the various pluralities of apertures 68 and 80 in the metal end plate 50 of the bearing support means 28 should be small enough to block microwave leakage therethrough. The number of holes may be increased as necessary to accommodate the desired rate of flow of air. Also, where the stirrer 72 is utilized, there is preferably a gap of at least one inch between the closest portion of the stirrer 72 and the projecting end of the magnetron antenna 56, to avod arcing therebeween, Referring to FIGS. 2 and 5, in accordance with one embodiment of this invention a rotating door structure, shown generally at 90, is provided to allow clothing to be introduced to and removed from the interior of drum 30. The door 90 includes an annular frame portion 92 which is hinged at 94 to a bracket 96 that is fastened to a flange 98 formed on the drum 30. The door 90 may be spring biased or latched by means (not shown) which cause the adjacent surfaces of the flange 98 and frame 92 to be pressed closely against one another. A central portion of the door preferably includes a multilayer closure comprising an outer clear acrylic plastic sheet 100 and an inner metallic mesh layer 102 which is electrically grounded to the frame portion 92 of the door in order to limit escape of microwave energy therethrough.

Although a leakage path for microwave energy exists between flange 98 and the adjacent inner portion of annular frame 92, such leakage is attenuated by providing a circumferential opening 104 adjacent the outer perimeter of the frame 92 which allows microwave energy to enter the interior portion of the frame 92. The length of leakage path and the dimensions of the interior portion of frame 92 are preferably chosen so that each approximates one-quarter of the wave length of the microwave energy employed in the dryer. Thus, the interior portion of frame 92 acts as a microwave choke to limit microwave leakage between the abutting surfaces of door 90 and drum 30.

Referring to FIG. 4, in order to attenuate the leakage of microwave energy that would otherwise occur in a leakage path extending from the interior of drum 30 to an through the space between annular pulley member 32 and bearing support member 28, the annular pulley member 32 includes a radially inner cylindrical wall 108 the end portion remote from drum 30 of which is provided with a circumferential opening 110 therein. The opening 110 communicates with the aforesaid leakage path from the interior of drum 30 to the space between annular pulley member 32 and bearing support member 28, so that microwave leakage energy passing thereby is introduced into the interior of annular puylley member 32. The effective length of the interior of annular pulley member 32 and the length of the leakage path from the interior of drum 30 to the opning 110 are so dimensioned that the interior of the annular pulley member 32 acts as a microwave choke or trap to attenuate microwave energy flowing along the leakage path (i.e., the length of the leakage path, shown by the broken line 112, should be approximately equal to the effective length of the interior of pulley member 32, shown by the broken line 114 within the annular pulley member 32, and both of these lines should be approximately equal to one-quarter of the wave length of the microwave energy employed in the dryer).

In order to further attenuate any microwave energy that might leak by the microwave choke portion of the annular pulley member 32, a gasket member 116 of diffused-ferrite-containing rubber, plastic or the like may be placed at the downstream end of the microwave leakage path 112, between the enlarged end portion 26 of the bearing support means 28 and the end face of the annular pulley member 32 which is nearest to such enlarged end portion 26. Further, an additional microwave attenuating gasket, for example a metallic mesh ring 118, can be placed in the microwave leakage path 112 between the enlarged end portion 48 of the bearing support means 28 and the end face of the annular pulley member 32 which is adjacent hereto. This would further attenuate the flow of leakage energy through the leakage path under discussion.

It should be noted that, since all of the weight of the drum 30, the door 90, and the wet clothes contained within the drum must be supported by the cantilevered bearing support member 28, this member should be constructed of a relatively heavy guage metal material and it should be securely fastened to the vertical support plate 22 which, in turn, should also be constructed of a relatively heavy gauge metal material. The annular pulley member 28 should also be of relatively thick metal construction so as to suitably support the rotary drum 30 on the bearing support member 28. A lubricant, for example grease, is preferably employed between the annular pulley member 32 and the surface of the cylindrical bearing support member 28 on which it rotates.

Figure 6:
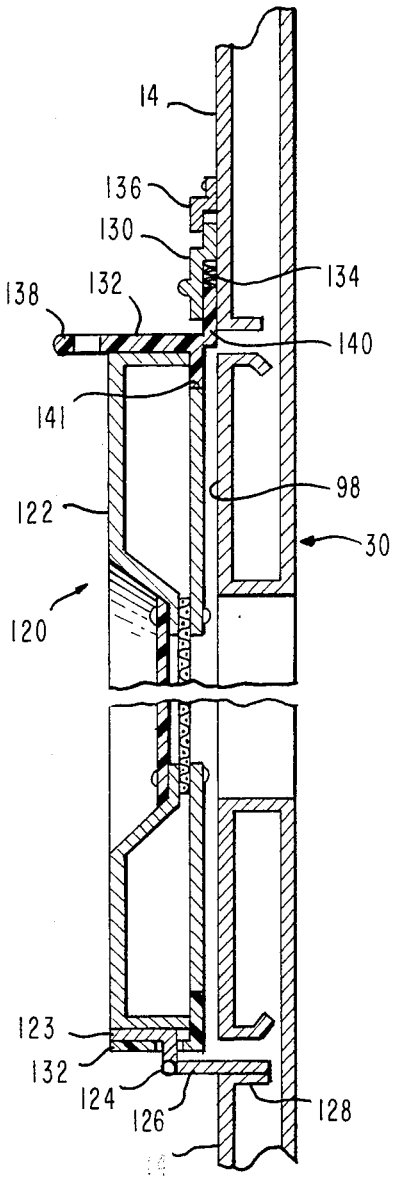
FIG. 6 is a view similar to FIG. 5 but showing details of the microwave leakage seal at the interface between the rotating drum and a stationary access door that may be employed with the present invention.

Referring to FIG. 6, in accordance with an alternative embodiment of this invention a non-rotating door structure, shown generally at 120, may be provided to allow access to the interior of drum 30 for the introduction and removal of clothing therefrom. The door 120 includes an annular frame portion 122 which has an angle member 123 fastened thereto. The angle member 123, in turn, is hinged at 124 to a bracket 126 that is fastened to a flange 128 formed on the stationary housing 14. The door 120 is locked by a latch member 130 which is slidably carried on an annular microwave-transparent plastic frame member 132 that is fixed to frame portion 122. The latch member 130 is upwardly biased by a spring 134 into engagement with a stationary clip 136 fixed to the frame member 14 above the door 120. The annular plastic frame member 132 includes a handle portion 138 at the top thereof, adjacent to latch member 130, to facilitate opening of the door upon depression of the latch member 130 against the bias of the spring 134. The annular plastic frame member 132 also includes a thickened vertical portion 40 adjacent to the latch 130 which serves to space the upper portion of the stationary door 120 from the adjacent rotating flange 98 on drum 30. The lower portion of the door 120 is spaced from the flange 98 by the bracket 126.

Preferably, the adjacent portions of door 120 and rotating flange 98 are spaced from one another by an amount, for example 2 mm, sufficient to insure that the two members do not rub against one another but which amount is still effective to allow the annular frame 122 to serve as a microwave choke with respect to a leakage path between flange 98 and the adjacent inner portion of annular frame 122. To this end a circumferential opening 141 is provided in the annular frame portion 122 which allows microwave energy to enter the interior portion of the frame 122 through the portion of the micrwave-transparent plastic frame member 132 that covers the opening 141. As in the case of the rotating door embodiment of FIGS. 2 and 5, the length of the leakage path and the dimensions of the interior portion of frame 122 are preferably chosen so that each approximates one-quarter of the wavelength of the microwave energy employed in the dryer. Thus, the interior portion of frame 122 acts as a microwave choke to limit mirowave leakage between the adjacent surfaces of door 1209 and flange 98 of drum 30.

It will be apparent from the foregoing description that this invention provides an improved microwave clothes dryer having a leakage sealing arrangement that is cooperatively integrated into the annular pulley member of the dryer's drum drive and support mechanism to attenuate the leakage of microwave energy therethrough. The annular pulley member employed in the dryer performs the improved combined functions of serving as a drive pulley for the dryer drum, serving as a sleeve bearing to rotatably support the dryer drum on a cantilevered bearing support member and serving as a microwave choke or trap which cooperates with the bearing support member in attenuating the leakage of microwave energy from the drum.

While particular embodiments of this invention have been shown and described, it will be obvious to those skilled in the art that various changes and modifications may be made without departing from this invention in its broader aspects, and it is, therefore, aimed in the appended claims to cover all such changes and modifications that fall within the true spirit and scope of this invention.

What is claimed is:

1. In a microwave clothes dryer including a housing, a drum rotatably supported in said housing, a microwave energy source, a drive motor, a drive pulley and a drive belt, the improvement comprising bearing support means having a generally cylindrical outer surface, an annular driven pulley member coaxial with and surrounding said bearing surface, said pulley member being fixed to said drum and rotated by said drive belt, said pulley member having an inner cylindrical surface which bears upon the outer surface of said bearing support means and forms therewith a microwave leakage path having a length equal to about a quarter of the wave length of the microwave energy employed in the said dryer, said inner surface of said pulley member having a circumferentially extending opening therein for introducing said microwave leakage energy into the interior of said pulley member, the effective length of the interior of said pulley member being equal to about a quarter of the wave length of said microwave energy, whereby attenuation of said microwave leakage energy occurs within said pulley member.

2. A microwave clothes dryer according to claim 1, wherein said drum is metallic and the interior of said drum is at least in part provided with a layer of non-conductive plastic material to inhibit arcing between said drum and metallic materials being dried in said drum.

3. A microwave clothes dryer according to claim 1, wherein said bearing support means includes at least one coaxial cylindrical flange thereon, said pulley member being axially spaced from said flange, and further including an annular soft, diffused-ferrite-containing, microwave absorbing gasket positioned between said pulley member and said flange and in communication with said microwave leakage path for further attenuating the flow of microwave leakage energy along said leakage path.

4. A microwave clothes dryer according to claim 3, wherein said bearing support means includes a second coaxial cylindrical flange thereon, said annular pulley member being axially positioned between said flanges, and further including annular metallic gasket means axially positioned between said pulley member and said second flange for further attenuating the flow of microwave leakage energy along said microwave leakage path.

5. A microwave clothes dryer according to any one of claims 1–4, wherein said drum is a tumbler type drum which rotates about a horizontal axis, and wherein said bearing support means and said annular pulley member are coaxial with said horizontal axis.

6. A microwave clothes dryer according to claim 5, wherein said bearing support means include an axial passageway therein which communicates with the interior of said drum, and further including blower means connected to said axial passageway for delivering forced air through said passage way to said drum.

7. A microwave clothes dryer according to claim 6, wherein said microwave energy source is positioned within said passageway so as to be cooled by said forced air and to heat said forced air prior to the latter's entry into said drum.

8. A microwave clothes dryer according to claim 1, wherein said circumferentially extending opening is positioned axially adjacent one end of said annular pulley member.

9. A microwave clothes dryer according to claim 8, wherein said one end of said annular pulley member is farther away from said drum than is the other end of said pulley member.

10. A microwave clothes dryer according to claim 7, further including shield means of microwave transparent material carried by an end face of said bearing support means and protruding into the interior of said drum for directing air from said passageway into said drum and for shielding said microwave energy source from articles tumbling within said drum.

* * * * *

UNITED STATES PATENT AND TRADEMARK OFFICE

CERTIFICATE OF CORRECTION

PATENT NO. : 4,765,066

DATED : August 23, 1988

INVENTOR(S) : Chang-Hyun Yoon

It is certified that error appears in the above-identified patent and that said Letters Patent is hereby corrected as shown below:

Column 2, line 19, "staed" should read --stated--.
Column 3, line 68, "of" should read --or--.
Column 4, line 26, after "the interior" insert --of bearing support member 28. Duct 82 is fastened--.
Column 5, line 42, "puylley" should read --pulley--.
Column 5, line 45, "opning" should read --opening--.
Column 6, line 38, "40" should read --140--.
Column 6, line 55, "micrwave" should read --microwave--.
Column 6, line 64, "1209" should read --120--.

Signed and Sealed this

Twenty-first Day of March, 1989

*Attest:*

DONALD J. QUIGG

*Attesting Officer*

*Commissioner of Patents and Trademarks*